US007525490B2

(12) United States Patent
Hung et al.

(10) Patent No.: US 7,525,490 B2
(45) Date of Patent: Apr. 28, 2009

(54) MULTI-BAND ANTENNA

(75) Inventors: Chen-Ta Hung, Tu-Cheng (TW); Shu-Yean Wang, Tu-Cheng (TW); Yun-Long Ke, Tu-Cheng (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 58 days.

(21) Appl. No.: 11/605,517

(22) Filed: Nov. 28, 2006

(65) Prior Publication Data

US 2007/0120753 A1 May 31, 2007

(30) Foreign Application Priority Data

Nov. 28, 2005 (TW) ..... 94141658 A

(51) Int. Cl.
*H01Q 1/24* (2006.01)
*H01Q 1/38* (2006.01)

(52) U.S. Cl. ..... 343/702; 343/700 MS; 343/829; 343/846

(58) Field of Classification Search ..... 343/702
See application file for complete search history.

(56) References Cited

U.S. PATENT DOCUMENTS

| | | | | |
|---|---|---|---|---|
| 6,864,845 | B2 * | 3/2005 | Kuo et al. | 343/702 |
| 7,009,536 | B1 * | 3/2006 | Gaus, Jr. | 341/118 |
| 7,109,923 | B2 * | 9/2006 | Ollikainen et al. | 343/700 MS |
| 7,161,543 | B2 * | 1/2007 | Cheng et al. | 343/702 |
| 7,289,071 | B2 * | 10/2007 | Hung et al. | 343/702 |
| 2005/0104788 | A1 * | 5/2005 | Hung et al. | 343/702 |

* cited by examiner

*Primary Examiner*—Trinh V Dinh
(74) *Attorney, Agent, or Firm*—Wei Te Chung

(57) ABSTRACT

A multi-band antenna adapted for used in a portable electronic device, includes: a first antenna including a first radiating element, a common grounding element, and a first connecting element connecting the first radiating element and the common grounding element; a second antenna, including a first radiating portion, the common grounding element, and a second connecting element connecting the radiating portion and the grounding element. Free end portions of the first radiating element and the first radiating portion do not align with each other in any direction.

9 Claims, 2 Drawing Sheets

MULTI-BAND ANTENNA

BACKGROUND OF THE INVENTION

1. Field of the Invention

The present invention relates generally to an antenna, and more particularly to a multi-band antenna used in a portable electronic device, such as a notebook.

2. Description of the Prior Art

With the development of wireless communication, more and more people hope to own portable electronic devices, such as a notebook, capable of connecting to Internet. The systems of the WLAN (Wireless Local-area Network) and the GPRS (General Packer Radio Service) can make the portable electronic devices, such as a notebook, work in Internet. The GPRS is a wide-area network and the data transfer speed thereof is 30 Kbps~50 Kbps. The WLAN is a local-area network and the data transfer speed is 11 Mbps. The portable electronic device, such as a notebook can choose different Wireless cards for jointing to Internet.

At present, the WLAN is based on Bluetooth technology standard or IEEE802.11 series technology standard. The frequency band of an antenna is 2.4 GHz and 5 GHz in IEEE802.11 series technology standard, but is 900 Mhz, 1800 MHz and 1900 MHz in GPRS technology standard. So, most antennas used in the notebooks work at the above-mentioned frequency bands in recent years.

PIFA (Planar Inverted-F Antenna) is a kind of minitype antenna usually used in a portable electronic device, such as a notebook. PIFA has compact structure, light weight, perfect impedance match, desired horizontal polarization and vertical polarization, and is easy to achieve multi-bands. So, more and more PIFAs are used in the portable electronic devices.

IEEE802.11 series technology standard comprises IEEE802.11a, IEEE802.11b and other different technology standards. The corresponding frequencies are different because of the different technology standards. So, PIFA usually has two radiating elements for providing two different frequencies.

The two different frequencies of the PIFA basically satisfy the requirements of the frequency band, while the radiating field usually has blind field making the signal not being radiated in some directions because of the characteristics of the two frequencies of the PIFA.

In the prior art, two same PIFAs being mirror image arranged to consist a PIFA system decrease radiating blind field. However, because the two PIFAs are mirror image arranged, a pair of radiating element ends of providing common frequency are mirror image arranged too, the PIFA system cannot distinguish which PIFA being a primary antenna and which being a secondary antenna, thus making the PIFA system occurring self-excitation. The self-excitation influences the natural work of the PIFA system. The radiating fields of the two mirror image arranged radiating elements occur superposition and radiating blind field.

Hence, in this art, a multi-band antenna to overcome the above-mentioned disadvantages of the prior art will be described in detail in the following embodiment.

BRIEF SUMMARY OF THE INVENTION

A primary object, therefore, of the present invention is to provide a multi-band antenna which can avoid self-excitation and fetch up radiating blind field.

In order to implement the above object and overcome the above-identified deficiencies in the prior art, a multi-band antenna adapted for used in a portable electronic device, comprising: a first antenna comprising a radiating element comprising a first radiating element, a grounding element, and a first connecting element connecting the radiating element and the grounding element; a second antenna comprising a radiating portion comprising a first radiating portion, the grounding element share with the first antenna, and a second connecting element connecting the radiating portion and the grounding element; wherein the free ends of the first radiating element and the first radiating portion locate on different lines.

Other objects, advantages and novel features of the invention will become more apparent from the following detailed description of a preferred embodiment when taken in conjunction with the accompanying drawings.

DETAILED DESCRIPTION OF THE INVENTION

Reference will now be made in detail to a preferred embodiment of the present invention.

Figure 1:
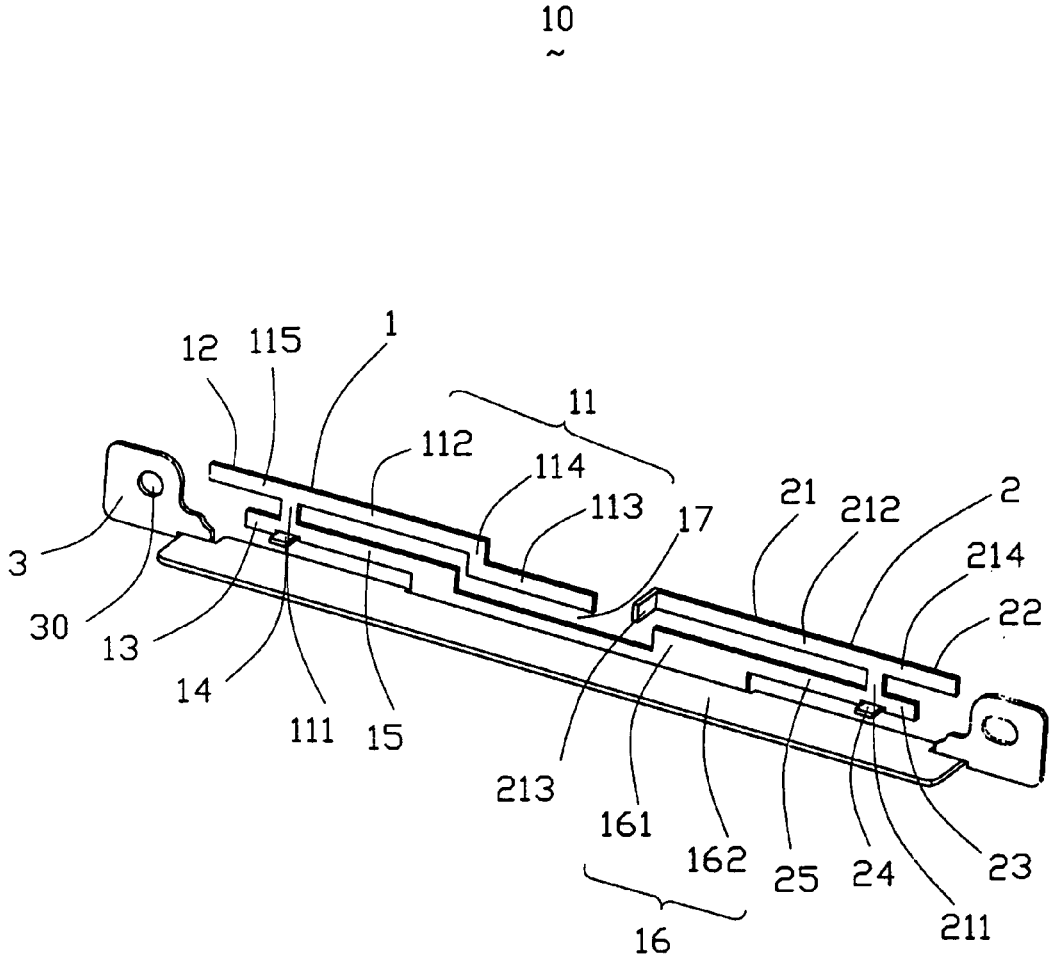
FIG. 1 is a perspective view of a preferred embodiment of a multi-band antenna in accordance with the present invention.
Figure 2:
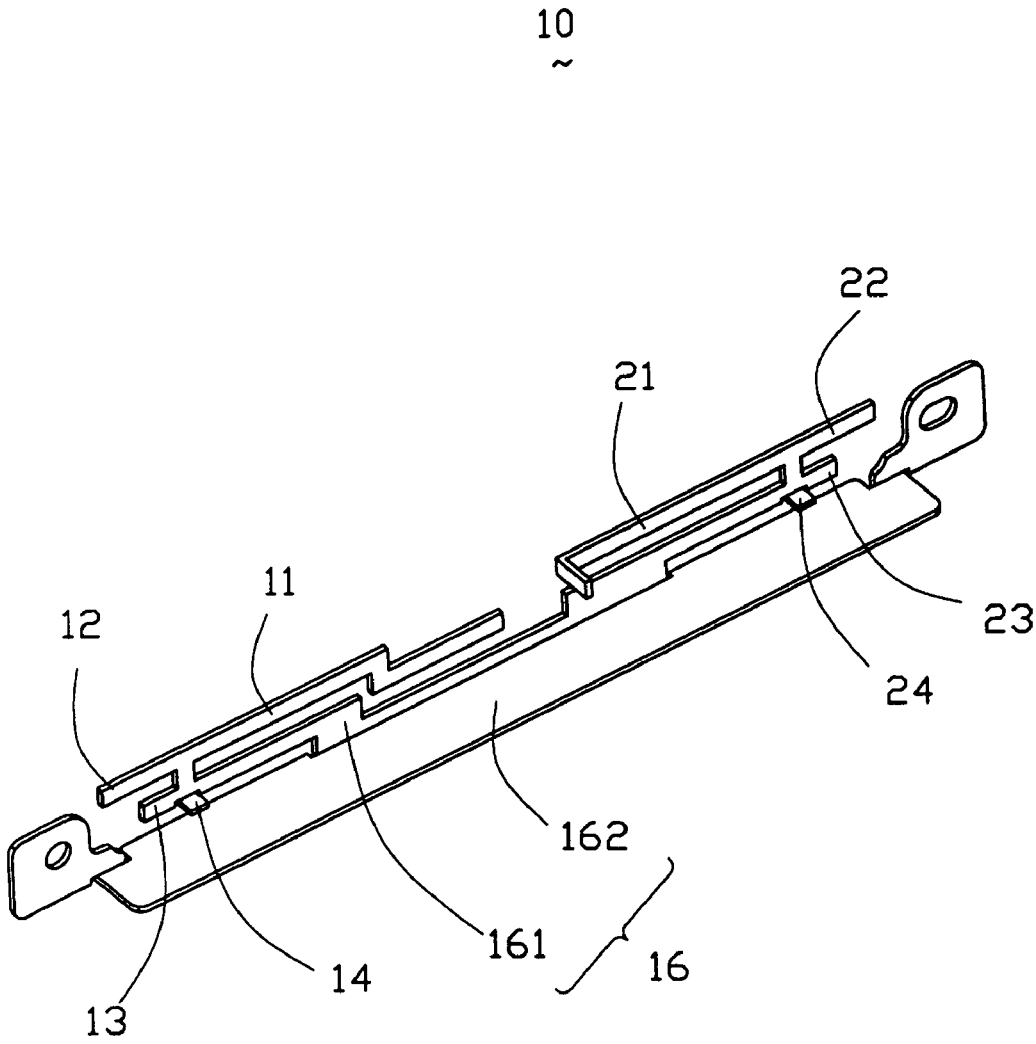
FIG. 2 is a perspective view similar to FIG. 1, but take from a different direction.

Referring to FIG. 1 and FIG. 2, a multi-band antenna 10 according to the preferred embodiment of the present invention is stamped and bent from a metal patch. The multi-band antenna 10 comprises a first antenna 1 and a second antenna. The first antenna 1 comprises a first radiating element 11, a second radiating element 12, a third radiating element 13, a first feeding cap 14, a first connecting element 15, a grounding element 16, and a first feeding line (not shown). The first radiating element 11 operates at 2.4 GHz of lower frequency band of IEEE802.1 a standard. The second radiating element 12 operates at 5 GHz of higher frequency band of IEEE802.11b/g. The third radiating element 13 is complementarity to the second radiating element 12 and enhances frequency band of the higher frequency. The second antenna 2 comprises a first radiating portion 21, a second radiating portion 22, a third radiating portion 23, a second feeding cap 24, a second connecting element 25, the common grounding element 16 sharing with the first antenna 1 and a second feeding line (not shown).

The first radiating element 11 comprises a first radiating arm 111 partaking with the second radiating element 12, a second radiating arm 112 perpendicularly extending from one end of the first radiating arm 111, a third radiating arm 113 being coplanar with the second arm 112 and located at different beelines, and a fourth radiating arm 114 connecting the second radiating arm 112 and the third radiating arm 113. The third radiating arm 113 and the fourth radiating arm 114 together form an L-shape. The second radiating element 12 comprises a fifth radiating arm 115 extending from one end of the first radiating arm 111 and located in the common beeline with the second radiating arm 112 extending along an opposite direction. The third radiating element 13 perpendicularly extends from the other end of the first radiating arm 111 and is parallel to the fifth radiating arm 115.

The first feeding cap 14 is a rectangular sheet and perpendicularly extends from the joint of the third radiating element 13 and the first radiating arm 111. The First feeding line comprises an inner conductor soldering at the first feeding cap 14 and an outer conductor soldering at the grounding element 16.

The grounding element 16 comprises a smaller first grounding plane 161 being coplanar with the three radiating elements 11, 12, 13 of the first antenna 1 and a bigger second grounding plane 162 perpendicular to the first grounding plane 161. A rectangular gap 17 is formed at a middle portion of the first grounding plane 161 for avoiding the third radiating arm 113 and the fourth radiating arm 114 extending and contacting the first grounding plane 161. Two longitudinal ends of the second grounding plane 162 each have an installing section 3 coplanar with the first grounding plane 161. The installing section 3 has an installing hole 30 for locking the multi-band antenna 10 on a portable electronic device, such as a notebook.

The first connecting element 15 extends from one end of the first grounding plane 161 connecting to the joint of the third radiating element 13 and the first radiating arm 111.

The first radiating element 11, the second radiating element 12, the third radiating element 13, the first connecting element 15, and the first grounding plane 161 are coplanar.

The first radiating portion 21 of the second antenna 2 operates at 2.4 GHz of a lower frequency band of the IEEE802.1 a technology standard. The second radiating portion 22 operates at 5 GHz of a higher frequency band of the IEEE802.11b/g technology standard. The third radiating portion 23 is complementarity to the second radiating portion 22 and enhances frequency band of the higher frequency.

The first radiating portion 21 comprises a first radiating branch 211, a second radiating branch 212 extending perpendicularly from one end of the first radiating branch 211 and being coplanar with the first radiating branch 211, a third radiating branch 213 extending from one end of the second radiating branch 212 and perpendicular to the plane in which the second radiating branch 212 is located. The third radiating branch 213 of the second antenna 2 and the first radiating arm 11 of the first antenna 1 are not coplanar. The second radiating branch 212 and the third radiating branch 213 together form an L-shape structure. The second radiating portion 22 comprises the common first radiating branch 211 sharing with the first radiating portion 21 and a fourth radiating branch 214 extending perpendicularly from one end of the first radiating branch 211 to an opposition direction compared with the second radiating branch 212.

The second connecting element 25 extends from the other end of the first grounding plane 161 to a joint of the third radiating portion 23 and the first radiating branch 211. The second connecting element 25 and third radiating portion 23 locate on one common line.

The second feeding cap 24 is a rectangular sheet and perpendicularly extends from the joint of the third radiating portion 23 and the first radiating branch 211. The First feeding line comprises an inner conductor soldering at the second feeding cap 24 and an outer conductor soldering at the grounding element 16.

The first radiating element 11 and the first radiating portion 21 operate at the same frequency, two free end portions of the first radiating element 11 and the first radiating portion 21 locate in different planes and are not arranged in a line because of the above design of the first radiating element 11 of the first antenna 1 and the first radiating portion 21 of the second antenna 2. The radiating field of the first antenna 1 and the second antenna 2 are not overlapped because of above design. The antenna module (not shown) connecting to the multi-band antenna 10 is easy to distinguish which is the main antenna and which is the secondary antenna for avoiding the multi-band antenna 10 occurring self-excitation. The secondary antenna can fully fetch up radiating blind field of the main antenna and the multi-band antenna 10 has better radiating performance of the lower frequency.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A multi-band antenna adapted for used in a portable electronic device, comprising:

a first antenna, comprising a first radiating element which comprises a first radiating arm, a second radiating arm extending from one end of the first radiating arm, a third radiating arm being coplanar with and locating at different beeline with the second radiating arm, and a fourth radiating arm connecting the second radiating arm to the third radiating arm, a second radiating element which comprises a common first radiating arm sharing with the first radiating element and a fifth radiating arm extending from one end of the first radiating arm and locating common beeline with the second radiating arm extending along a opposition direction, a common grounding element, and a first connecting element connecting the first radiating element and the common grounding element, said first radiating element of the first antenna form an L-shape locating in a plane, the first radiating portion of the second antenna form an L-shape locating in a different plane.

a second antenna, comprising a first radiating portion, the common grounding element sharing with the first antenna, and a second connecting element connecting the radiating portion and the grounding element; wherein two free end portions of the first radiating element and the first radiating portion are not arranged in a line, said free end portion of the first radiating element locates at the terminal of the first radiating element, said free end portion of the first radiating portion locates at the terminal of the first radiating portion, said third radiating arm is the free end portion of the first radiating element.

2. The multi-band antenna as claimed in claim 1, wherein the free end portions of the first radiating element and the first radiating portion locate in different planes.

3. The multi-band antenna as claimed in claim 1, wherein the first radiating element and the first radiating portion operate at the same frequency.

4. The multi-band antenna as claimed in claim 1, wherein the second antenna further has a second radiating portion having a first radiating branch sharing with the first radiating portion, the first radiating portion also comprises a second radiating branch extending vertically from one end of the first radiating branch and being coplanar with the first radiating branch and a third radiating branch extending from one end of the second radiating branch, the second radiating portion also comprises a fourth radiating branch extending perpendicularly from one end of the first radiating branch.

5. The antenna as claimed in claim 4, wherein the first antenna further comprises a third radiating element perpendicularly extending from the other end of the first radiating arm and paralleling to the fifth radiating arm, the second antenna further comprises a third radiating portion extending from one end of the first branch and being parallel to the fourth radiating branch.

6. The antenna as claimed in claim 4, wherein the grounding element comprises a first grounding plane being coplanar with the radiating element of the first antenna and a second grounding plane perpendicular to the first grounding plane, the first grounding plane has a rectangular gap formed at middle portion thereof.

7. The antenna as claimed in claim 6, wherein the first connecting element and the second connecting element respectively extend from the two ends of the first grounding plane, the first connecting element connects to the joint of the first radiating arm and the third radiating element, the first connecting element and the third radiating element locate on one common line, the second connecting element connects to the joint of the first radiating branch and the third radiating portion, the second connecting and the third radiating portion locate on one common line.

8. The antenna as claimed in claim 6, wherein the first antenna has a first feeding cap for connecting a feeding line perpendicularly extending from the joint of the first radiating arm and the third radiating element, the second antenna has a second feeding cap for connecting the feeding line perpendicularly extending from the joint of the first radiating branch and the third radiating portion.

9. A multi-band antenna adapted for used in a portable electronic device, comprising:

a common grounding element;

a first antenna comprising a first radiating element with a first connecting element connecting with the common grounding element; and a second antenna comprising a first radiating portion with a second connecting element connecting with the grounding element; wherein the first antenna and the second antenna are essentially symmetrically arranged with each other with regard to a central line of the common grounding element except that two opposite inner end portions of said first antenna and said second antenna, which are essentially closer to each other than any other portions of said first antenna and said second antenna, are not coplanar with or not parallel to each other.

* * * * *